United States Patent [19]

Dreher

[11] 3,965,620

[45] June 29, 1976

[54] DRUM POLISHING APPARATUS

[75] Inventor: Manfrid Dreher, Engelsbrand, Germany

[73] Assignee: Dr.-Ing. Manfrid Dreher KG apparatebau und chemisch Verfahrenstechnik fur Oberflachenbehandlung von Metallen, Engelsbrand, Germany

[22] Filed: Aug. 8, 1974

[21] Appl. No.: 495,640

[30] Foreign Application Priority Data

Aug. 16, 1973 Germany ..... 2341268

[52] U.S. Cl. ..... 51/164

[51] Int. Cl.[2] ..... B24B 31/02

[58] Field of Search ..... 134/65, 132; 198/213; 51/7, 164

[56] References Cited

UNITED STATES PATENTS

| | | | |
|---|---|---|---|
| 2,517,073 | 8/1950 | Alvarez | 198/213 X |
| 2,889,575 | 6/1959 | Larson | 198/213 X |
| 3,306,433 | 2/1967 | Blanshine | 198/213 |

FOREIGN PATENTS OR APPLICATIONS

| | | | |
|---|---|---|---|
| 777,848 | 6/1957 | United Kingdom | 51/164 |

*Primary Examiner*—Harold D. Whitehead
*Attorney, Agent, or Firm*—Murray Schaffer

[57] ABSTRACT

Drum polishing and tumbling apparatus having a cylindrical casing rotated about its central axis. A screw conveyor is located within the casing substantially from one end to the other. The screw conveyor is rotated about its axis relative to the casing. The screw conveyor extends radially outward into proximity to the surface of the inner wall of the casing. Seal means is provided if desired between the blade of the screw conveyor and the surface of the casing. The screw conveyor is journaled in bearings located in the end walls of the cylinder and is independently and selectively rotated.

15 Claims, 2 Drawing Figures

DRUM POLISHING APPARATUS

BACKGROUND OF THE INVENTION

The present invention relates to a method and apparatus for simultaneously mechanically treating the surface of small parts and in particular to a drum tumbling apparatus for grinding and/or polishing particulate materials such as small machine parts, nuts, bolts and the like.

Drum apparatus for the grinding and/or polishing of metallic parts and the like are already known. In general such apparatus comprises a cylindrical drum, rotatable about its central axis having an opening at one end for the supply of material to be treated and the polishing media (generally an aqueous mixture of abrasives) and an opening at its other end for the discharge of the material and the media. In this type of installation, the ability of feeding the material and media from one end while simultaneously discharging it from the other end, permits the processing of small parts in a continuous operation. The material throughput can be adjusted by regulating the supply at the inlet end while simultaneously regulating the rotation of the drum. The material fed at the inlet acts to push the material already in the drum outwardly of the discharge opening, this movement being enhanced by the speed of rotation of the drum. Because of the automatic passage of the material through the drum, the length of time that the material spent in the drum was generally insufficient to obtain optimum surface treatment and it was therefore necessary, in the past, to superimpose upon the drum a second rotary movement about an axis other than the central axis of the drum, so as to create centrifugal forces which would accelerate the scouring or polishing process. As a result of the added centrifugal force, the material was capable of being completely treated even during only a short passage through the drum. For this purpose, at least two drums were mounted so as to be rotatable with their ends diametrically opposite one another between two supporting discs. The supporting discs were also driven so that in the course of operation the drums would be rotated about their own axes and perform a revolving motion about the axis of the discs. Such apparatus was shown and described in the German Pat. publication No. 2135,052 and in United States It will be obvious, however, that the known apparatus was complex in both its structure and in its operation.

It is the object of the present invention to provide drum grinding and polishing apparatus which is simple in structure and easily employed.

It is a further object of the present invention to provide drum grinding and polishing apparatus in which the operations can be carried out both in the batch and/or in the continuous processes.

It is a further object of the present invention to provide drum grinding and polishing apparatus in which the drum is caused to rotate only about its own central axis and yet provide the necessary control and regulation of the rate of throughput.

It is a general object of the present invention to provide drum grinding and polishing apparatus which is improved over the prior art and which overcomes the disadvantages and defects of the known apparatus.

The foregoing objects, other objects and numerous advantages of the present invention will be apparent from the following disclosure thereof.

SUMMARY OF THE INVENTION

According to the present invention apparatus for the mechanical surface treatment of particulate materials such as small machine parts, nuts, bolts and the like is obtained by providing a drum installation comprising a cylindrical casing adapted to be rotated about its central axis and by locating within the cylindrical casing a screw conveyor which is adapted to be rotated about its own axis relative to the outer casing. The screw conveyor extends substantially along the length of the casing and radially outward in proximity to the surface of the inner wall of the casing.

With the foregoing apparatus, even with the introduction of the material and media at one end and its discharge from the opposite end, the rate of throughput can be selectively controlled by regulating the relative speed and duration of the screw conveyor with respect to the casing.

Preferably, the cylindrical casing is externally supported on a plurality of rollers, some of which are driven so as to rotate the casing about its central axis. The screw conveyor comprises an axle and a spiral blade, the axle being journaled in bearings which form the hub or center of the end walls of the casing. The axle is driven by motor means which is independently controlled from the means which drive the rollers supporting the casing.

The surface of the inner wall of the casing may be coated with an elastically resilient material, such as rubber. In addition, seal means, may be provided between the blade of the screw conveyor and the inner surface of the casing, so that the conveyor and the casing define a plurality of pockets or chambers through which the material and media must pass. The seal means may itself define a space between the blade and the surface of the chamber which may be filled with a lubricant or sliding agent which reduces friction between the screw conveyor and the casing and which allows relatively high rotary speeds to be obtained.

Full details of the present invention are set forth in the following disclosure and are illustrated in the accompanying drawings.

DESCRIPTION OF THE INVENTION

Figure 1:
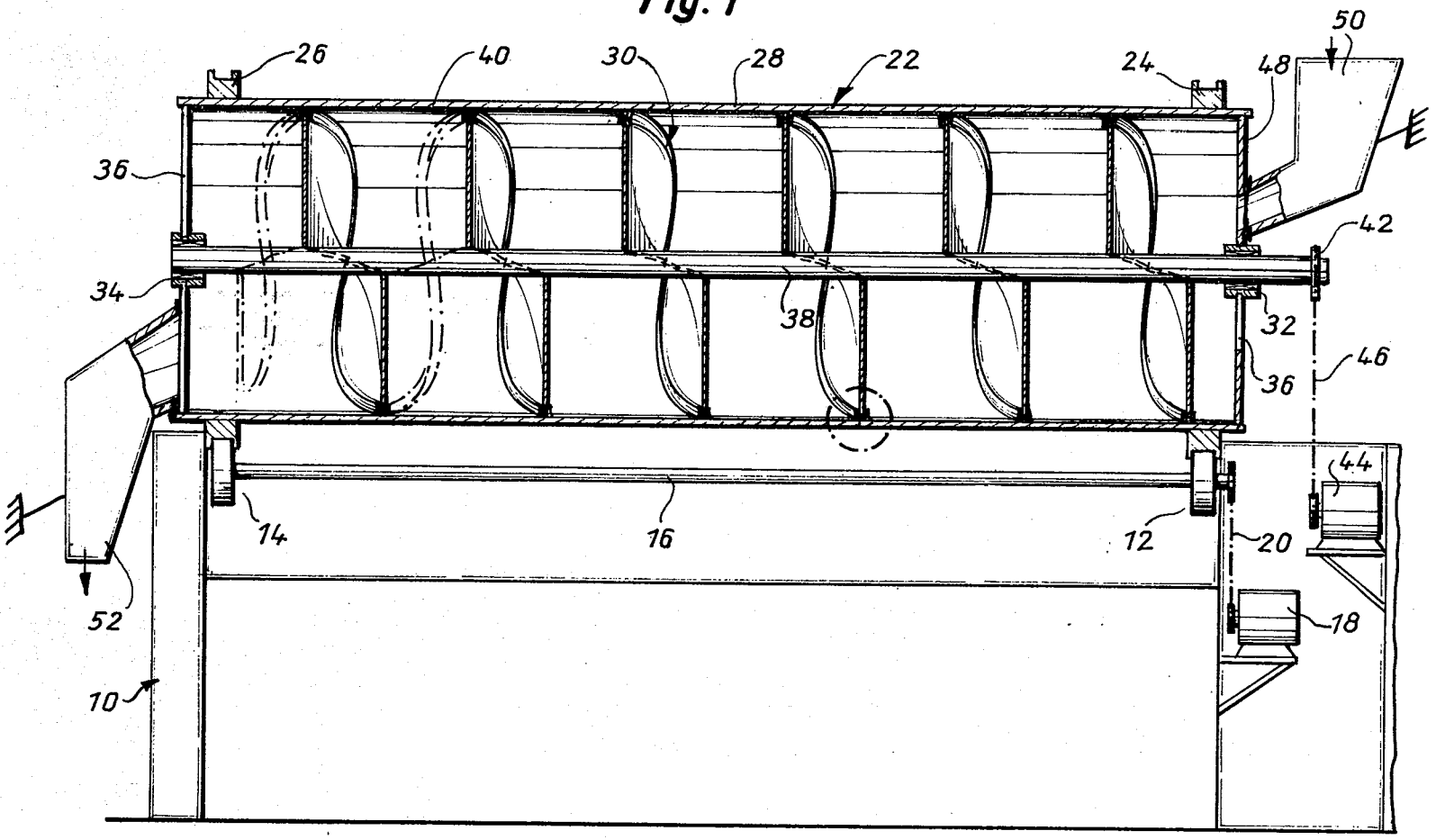
FIG. 1 is a longitudinal section through a drum installation embodying the present invention.

The installation as seen in FIG. 1 comprises a base frame 10 of generally rectangular configuration. In the vicinity of each of the end sides of the machine frame 10 and adjacent its upper or top edge, there is journaled two pair of rollers 12 and 14, of which only one roller of each pair is seen. The rollers of each pair are aligned transversely of the frame and coaxially, along the length of the frame, with those of the other pair so that a parallel quadrilateral arrangement is obtained. The individual rollers of each pair are interconnected with corresponding rollers of the other pair by being fixedly secured at their centers to the respective ends of a shaft 16. One set of rollers 12 and 14 function as a drive roller for the support of the drum, while the other set of rollers 12 and 14 are spaced therefrom and are freely rotatable so that they serve merely to support in combination with the drive rollers the drum.

The set of rollers 12 and 14, which serve to drive the drum, are seen in FIG. 1. Its shaft is connected to a drive motor 18 by a suitable pulley and belt transmission. The drive motor 18 is mounted on the frame and is a suitable variable speed reversible electric motor. The motor is provided with switch and current control means by which it may be selectively regulated as to speed, direction of rotation, and duration of operation.

The two pairs of rollers 12 and 14 are adapted to externally support an elongated drum, generally depicted by the numeral 22. The drum, is provided on each of its ends with a peripherally grooved annular rim 24 and 26 which is adapted to fit on the rollers 12 and 14 respectively. The drum 22, itself comprises a hollow cylindrical casing 28 in which a screw conveyor 30 is located. The screw conveyor is rotatably journaled in a pair of bearings 32 and 34, located along the central axis of the casing 28, forming the hubs of the axial ends 36 of the casing. The axial ends 36 of the cylindrical casing 28 are preferably formed of a plurality of radial spokes extending in star-like fashion from the outer periphery of the bearings 32 and 34, respectively to the edge of the casing 28. In this manner, the casing 28 is formed with generally open ends. The screw conveyor 30 comprises a central tubular axle 38 which is received at each of its ends in the respective bearings 32 and 34 and a spiral blade 40 integrally formed or unitarily secured to the tubular axle. The spiral blade 40 may be formed from a single plate or from a plurality of metal plates bent and joined into the form of a spiral worm-like conveyor. The conveyor extends substantially from one end of the casing to the other and radially outward into close proximity to the inner surface of the casing 28.

At the right side, as seen in FIG. 1, the axle 38 protrudes outwardly of the bearing 32 and is provided with a pulley 42 which is connected to an adjustable variable speed motor 44 by a suitable belt or chain drive 46. The motor 44 is independent of the motor 18 which drives the casing 28 and is itself provided with suitable switch and current control means for regulating its speed, direction and its duration of operation.

Further, as seen in FIG. 1, the right end of the cylinder casing 28 comprises the inlet end for the supply of material to be treated as well as the media by which it is treated. This end 36 is provided with an annular wall 48 which has a central opening, the inner periphery of which concentrically surrounds and is spaced radially from the hub bearing 32. The annular wall 48 and the spokes forming the wall 36 at this end can be welded together along the inner peripheral edge of the wall 48. The end wall 48 thus forms a central inlet to the drum, the opening of which is concentric and as close to the central hub 32 as possible. An inlet chute or funnel 50 is mounted adjacent the inlet opening so that the material to be treated and the media may be directed therein. Suitable means for controlling the rate of feed, can be provided, although the same are not shown in the drawing.

At the opposite end, or the left end as seen in FIG. 1, the spoke-like wall 36 is left generally open and an outlet chute or funnel 52 is similarly mounted so as to permit the discharge of the material and media from that end. The outlet funnel 52 is arranged at the radially outer edges of the cylindrical casing 28 and is provided in conventional manner with means for separating the polishing media from the material to be treated as they are centrifugally ousted therethrough.

The peripheral edge of the blade 40, forming the screw conveyor 30 extends radially outward toward the inner wall of the casing 28 where it ends proximally of and just short of contact with engagement with the wall. In this manner the screw conveyor defines with the casing 28 a series of interconnected pockets or a helical chamber through which the material and media may successively and sequentially pass after introduction through the funnel inlet 50, on its way to being discharged out of the funnel 52. The screw conveyor 30 can be rotated relative to the casing 28 while simultaneously the casing 28 can itself be rotated about the screw conveyor. It is noted that the axis of rotation of both the screw conveyor and the casing 28 is the same. The rotation of both the casing 28 and the conveyor 30 cause the material to be simultaneously tumbled and treated while being moved from the inlet to the outlet end. Because of the relative movement of the conveyor and the casing and the ability to selectively operate the two independently of the other variable degrees of treatment and length of dwell time within the casing 28 can be created.

It is an advantage to drive both the drum and the worm conveyor separately by means of their individually geared motors by further providing switch means and current control means for each of the motor drives, their relative speed duration and direction can be selectively adjusted and varied so that a continuous operation for predetermined intervals of time can be obtained or in the alternative defined intervals of operation for either the casing or the conveyor can also be obtained. Either the casing or the screw conveyor can be reversed in direction or stopped to enable further control of the material within the apparatus.

Charging or feeding of the drum as well as its discharge can be obtained in various ways. The end of the drum, for example, can be encased in an enclosed housing to which the material to be treated and the treating media can be delivered from a storage container, by means of slides, screw conveyors or similar means of transport. These means of transport may on the other hand be used to supply the funnel 50 directly and may be used to remove the material from the funnel 52 in a similar manner.

It is advantageous to coat the surface of the inner wall of the casing 28 with a layer of an elastically resilient material such as rubber, plastic or the like. In this manner, the surface of the casing may be protected against rust and/or corrosion and the space between the peripheral edge of the blade 40 and the surface of the casing can to some extent be sealed while relative rotation of the screw conveyor 30 with respect to the casing 28 can be maintained. The coating may also act as a sound damper.

Figure 2:
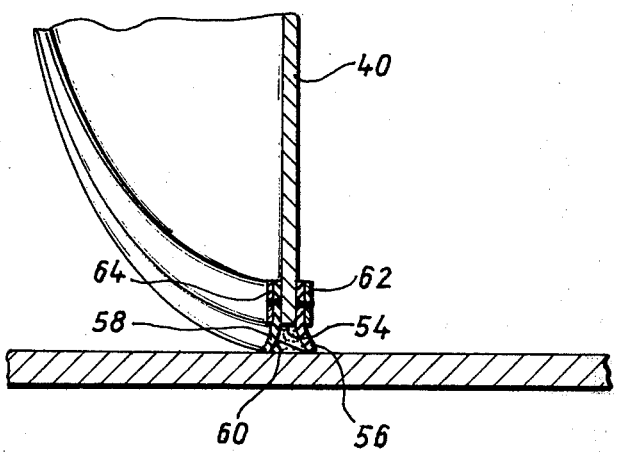
FIG. 2 is an enlarged sectional view of the portion shown in FIG. 1 in the dot-dash circle.

To provide improved functioning and movement of the media and the material through the casing and to prevent particulate matter, such as the parts being treated or the abrasive material from becoming stuck between the peripheral edge of the blade and the surface of the casing, it is advantageous to provide a more positive seal between the peripheral edge of the blade 40 and the inner surface of the casing. An example of such a seal is seen in FIG. 2, wherein the blade 40 is constructed so that its peripherally radially outer edge 54 is spaced at a distance from the surface of the inner wall of the casing 28. This distance is bridged by a pair of flexible strips 56 and 58, which engage with the surface of the inner wall of the casing. The strips 56 and 58 define with the edge 54 and with the surface of the inner wall, a space 60 which is enclosed on all sides and which extends the entire length of the spiral blade. This space 50 may be filled with a suitable sliding agent such as a lubricant, soap or detergent preferably in an aqueous solution so that it will be compatible with the polishing media. This sliding agent functions to prevent the screw conveyor from adhering to the surface of the inner wall, particularly during start up of operations and further prevents serious wear of the sealing strips 56 and 58 due to the creation of excessive frictional effects, particularly during high speed operation. Preferably the seal strips 56 and 58 are elastically resilient and may be made from a suitable rubber or plastic material. The seal strips are secured to the opposite faces of the blade 40, respectively, by a pair of metal strips 62 and 64 which may be bolted or screwed to the blade, so as to allow the seal strips to be replaced or exchanged when necessary. Suitable inlet nozzles or fittings can be provided so that the lubricant can be replenished and supplied to the space 60 from time to time without the need to dismantle the screw conveyor or to remove the seal strips.

It will be obvious that only one seal strip may be used, with or without the lubricant if desired. A unitary seal having a peripheral groove can also be used, rather than the use of two seal strips. The peripheral groove will hold the lubricant in the same manner as described.

In the operation of the apparatus described, it is advantageous to control the relative speeds, duration and direction of both the conveyor and the casing. It is therefore advantageous to drive both the drum and the screw conveyor separately by means of their individually geared motors. A single motor with suitable individual transmissions may also be used. The use of individual switch means and current control means for controlling the operation of each of the motors has the advantage that the operation of the screw conveyor with respect to the casing can be controlled so that it can be made continuous for determined time intervals or in the alternative it may in any predetermined interval of time be capable of being varied in speed, reversed in direction and/or entirely stopped. In the apparatus, characterized by the features of the present invention the dwell time of the material within the casing, and its degree of treatment can be controlled by means of the screw conveyor. By selectively matching the speed and direction of rotation of the casing and the screw conveyor, the contents of the drum are either retained for certain periods of time and discharged from it in batches or else the casing can be run continuously and a continuous throughput operation be maintained. The present apparatus thus makes it possible for a single drum installation of this type to be integrated in a train or line of production machines by which the parts to be treated are actually machined or formed. The time of passage of the contents of the drum can be adjusted in such a way that a continuous flow of production is insured. Thereby, the waste of time caused by the conventional charging and emptying of separate drum installations, remote from the other production facilities, is avoided.

By equipping the casing with a screw conveyor, the interior of the casing is divided into a plurality of specially shaped inner chambers which insure, in every area of the casing, a uniform circulation of the small parts to be ground and/or polished. Furthermore, the special division of the inner space of the casing, makes it possible to select drum speeds in such a way as to create a centrifugal action which produces a relatively high specific compression of the parts being treated. As a result extremely short processing times can be obtained.

By the use of the screw conveyor it is possible, as stated above, to control more accurately and efficiently the movement of the material from one end of the casing to the other. By a choice between the stationary state of the screw conveyor and selective corresponding speeds and directions of rotation of the screw conveyor and the casing, the adherence of the material to the inner peripheral wall of the casing created by the centrifugal forces at appropriate casing speeds can be obtained so that optimal and most efficient results can be achieved. In particular, the present invention makes it possible, by rotating the screw conveyor and the casing in opposite directions and at equal speeds, for the material not to be moved at all within the drum. Instead the material may be thus intensively processed by reciprocal rolling of the parts with respect to each other in the polishing media. It is also possible to control the movement of the material in the casing so that it moves in intermittent steps. Thus the material can be supplied to the casing in batches if this is necessary.

The provision of an elastically resilient layer on the inner surface of the casing enables the operation of the casing at relatively high rotary speeds. Rubber is a particularly suitable material for this purpose. Further advantageous function is obtained by providing the peripheral edge of the blade of the conveyor with elastically resilient sealing means which engage the inner surface of the casing. The sealing means provided prevents the migration of the abrasive polishing agent and the parts to be treated from one of the defined inner chambers or spaces to the other. By providing the seal means with a lubricant or sliding agent the rotation of the screw conveyor with respect to the casing is greatly enhanced and wear on the seal means is reduced.

The formation of the casing itself is rather simple and providing its ends with spoke-like members simplifies the formation of inlet and outlet openings by which the material may be passed into and out of the casing. It further enables the simple journaling of the screw conveyor by providing its bearings as the central hub of the axial ends of the casing.

From the foregoing it will be obvious that the present invention provides the ability to control the passage of the contents through the casing in such a way that it may be efficiently and selectively treated in short time intervals so that optimum working results can be obtained. Various modifications and embodiments as well as numerous changes in the specific design of the present apparatus have been suggested in the preceding description. Other such changes and embodiments and modifications will be obvious to those skilled in the present art. It is accordingly intended that the present disclosure be taken as illustrative of the invention and not as limiting of its scope.

I claim:

1. Drum apparatus for the mechanical surface treatment of particulate material by a suitable media comrpising a cylindrical casing adapted to be rotated about its central axis, an inlet at one end for the supply of media and material and an outlet at the other end for the removal of said media and material, a screw conveyor located within said casing adapted to be rotated relative to said casing to move said media and material, said screw conveyor extending substantially the length of said casing and radially outward into proximity with the surface of the inner wall of said casing and comprising an axle and a spiral blade integrally formed therewith, said axle being journalled in bearings located at each end of said casing comprising a central hub surrounding said axle and support means extending radially outward in connection with said casing, said support means having an opening therein adapted to align with said inlet and outlet means on rotation of said casing, and means for variably rotating each of said casing and screw conveyor independently of the other, to obtain selectively variable relative speed therebetween.

2. The apparatus according to claim 1 including a base, roller means journaled on said base and spaced from each other to externally support said rollers and means for driving at least one of said rollers to rotate said casing.

3. The apparatus according to claim 1 wherein the surface of the inner wall of said casing is coated with a layer of an elastically resilient material.

4. The apparatus according to claim 3 wherein said elastically resilient material is rubber.

5. The apparatus according to claim 1 wherein the bearings for said screw conveyor comprise a central hub and a plurality of spokes extending radially outward from said bearing to said casing.

6. The apparatus according to claim 1 wherein said means for rotating each of said casing and screw comprises a variable speed reversible motor.

7. The apparatus according to claim 6 wherein said motor is connected to said axle for driving said screw conveyor independently of said casing.

8. The apparatus according to claim 1 including motor means for driving each of said casing and screw conveyor and transmission means for varying speed, direction and interval of rotation of each relative to the other.

9. The apparatus according to claim 1 including at least one flexible sealing lip secured to the peripheral edge of said screw conveyor and slidably engaging the surface of the inner wall of said casing.

10. The apparatus according to claim 9 wherein the seal means comprise a pair of elongated flexible strips defining with the peripheral edge and the surface of the inner wall a continuous chamber for retention of a sliding agent therein.

11. The apparatus according to claim 10 wherein the sliding agent is a lubricant.

12. The apparatus according to claim 10 wherein the sliding agent is a soap.

13. The apparatus according to claim 10 wherein said flexible strips are elastically resilient.

14. The apparatus according to claim 13 wherein said elastic strips are rubber.

15. The apparatus according to claim 9 wherein the surface of the inner wall is coated with a layer of an elastically resilient material.

* * * * *